US005211036A

United States Patent [19]

Engelfried et al.

[11] Patent Number: 5,211,036

[45] Date of Patent: May 18, 1993

[54] DEVICE FOR REMOVAL OF A ROLL OF TUBULAR FABRIC

[75] Inventors: Werner Engelfried, Sindelfingen; Gerhard Müller, Esslingen, both of Fed. Rep. of Germany

[73] Assignee: Terrot Strickmaschinen GmbH, Stuttgart, Fed. Rep. of Germany

[21] Appl. No.: 837,869

[22] Filed: Feb. 18, 1992

[30] Foreign Application Priority Data

Mar. 9, 1991 [DE] Fed. Rep. of Germany ..... 4107690

[51] Int. Cl.[5] ..... D04B 15/88

[52] U.S. Cl. ..... 66/151; 242/62

[58] Field of Search ..... 66/151, 147, 148, 149 R, 66/152, 153, 150; 242/62, 58.6; 414/910, 911

[56] References Cited

U.S. PATENT DOCUMENTS

| | | | |
|---|---|---|---|
| 2,984,429 | 5/1961 | Huck | 242/58.6 |
| 3,985,001 | 10/1976 | Esehenbach | 66/149 R |
| 4,079,600 | 3/1978 | Amaya et al. | 66/147 X |
| 4,233,825 | 11/1980 | Glaspie | 66/149 R X |
| 4,807,451 | 2/1989 | Goller et al. | 66/149 R |
| 4,888,963 | 12/1989 | Scherzinger et al. | 66/151 |
| 4,934,413 | 6/1990 | Yao | 414/911 |

FOREIGN PATENT DOCUMENTS

| | | | |
|---|---|---|---|
| 130145 | 6/1959 | U.S.S.R. | 66/151 |

*Primary Examiner*—Clifford D. Crowder
*Assistant Examiner*—Larry D. Worrell
*Attorney, Agent, or Firm*—Shenier & O'Connor

[57] ABSTRACT

A device for the removal of tubular fabric from a circular knitting machine comprises a machine frame, a driven take-up roller around which the tubular fabric is partially wound, a winding rod for winding the tubular fabric and two bearings at the ends of the winding rod. The bearings of the winding rod are arranged in levers which are pivotally mounted on the machine frame for pivoting from an operating position to a removal position. In the operating position, the winding rod can be locked in position by wedge-shaped locking elements. In the removal position, the winding rod can be removed from the machine frame simply and easily.

3 Claims, 3 Drawing Sheets

DEVICE FOR REMOVAL OF A ROLL OF TUBULAR FABRIC

BACKGROUND OF THE INVENTION

The invention relates to a device for removal of a roll of tubular fabric from a circular knitting machine comprising a machine frame, at least one driven take-up roller mounted on the machine frame and having the tubular fabric partially wound around it and a free-wheeling winding rod spaced from the take-up roller and rotatably mounted at its ends in two bearing locations, the roll of tubular fabric being formed on the winding rod, the tubular fabric being guided from the take-up roller to the roll of tubular fabric, from this to the take-up roller again and from there into the roll of tubular fabric.

A draw-off and take-up device for circular knitting machines of the type described in the aforesaid is known from German patent specification 2 417 799. While this describes a take-up arrangement for the roll of tubular fabric, it does not specify how the voluminous roll of tubular fabric which can weigh up to 150 kg or more is to be removed from the machine in a manner which is as convenient as possible. In fact, two people (knitters) are required to remove such large and heavy rolls of tubular fabric from the machine.

SUMMARY OF THE INVENTION

The object underlying the invention is to provide a device for removal of a roll of tubular fabric from a circular knitting machine of the specified type which enables a single person to remove a roll of tubular fabric quickly and in a simple manner from the circular knitting machine.

The object is accomplished in accordance with the invention in that the ends of the winding rod are arranged in levers pivotally mounted on the machine frame, the levers being pivotable back and forth between an operative position and a removal position, and that the ends of the winding rod, in its operative position, are lockable on the machine frame together with the levers by a locking means. In the removal position, the levers are pivoted manually or by means of drive motors such that the winding rod with the roll of tubular fabric can be removed easily and quickly from the circular knitting machine. The roll of tubular fabric can, in this case, be considerably larger and heavier than in the above-mentioned, known device for drawing off and taking up knitted fabric. It can, for example, have a weight of 200 to 300 kg. Nevertheless, the roll of tubular fabric can be removed by a single person in a simple and reliable manner.

BRIEF DESCRIPTION OF THE DRAWINGS

The following description of a preferred embodiment of the invention serves to explain the invention in greater detail in conjunction with the attached drawings. In these drawings.

DESCRIPTION OF THE PREFERRED EMBODIMENT

Figure 1:
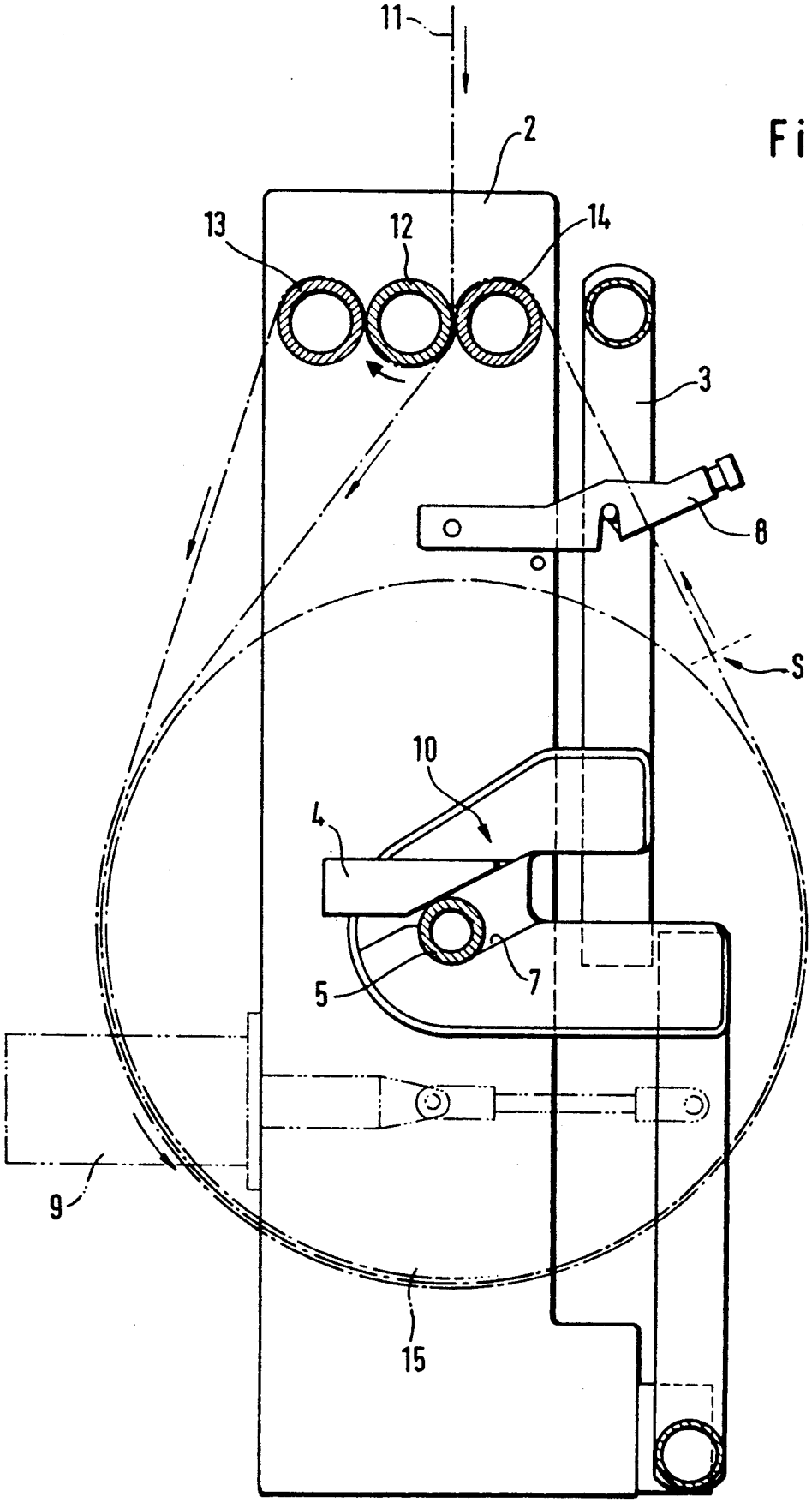
FIG. 1 is a schematic side view of a device for removal of a roll of tubular fabric in the operative position.

As shown in FIG. 1, a tubular fabric 11, which is to be removed from a circular knitting machine not illustrated in the drawings, is wound first of all about a first take-up roller 12 mounted on a machine frame 2, then about a second take-up roller 13 also mounted on the machine frame 2, whereupon it runs around a roll of tubular fabric 15, is then wound around a third take-up roller 14 mounted on the machine frame 2 and finally runs into the roll 15. In this way, the roll is caused to rotate automatically by the parts of the tubular fabric running between the roll and the rollers 13 and 14, respectively. At the beginning of the winding process, the leading end of the tube 11 is automatically joined in a manner known per se to a winding rod 5. The take-up rollers 12, 13 and 14 are coupled with one another in a suitable manner, for example by gear wheels, so that only one of them has to be driven. Two levers 3 are pivotally mounted on the machine frame 2. Grooves 7 are formed in each of the levers, for example in a curvature 10, and these rotatingly receive the ends of the winding rod 5. In the operative position, each of the ends of the winding rod 5, which is held by the effect of gravity in the grooves 7, is locked in position on the machine frame 2, as shown in FIGS. 1 and 3, together with the levers 3 by means of a wedge-shaped locking means 4.

Figure 3:
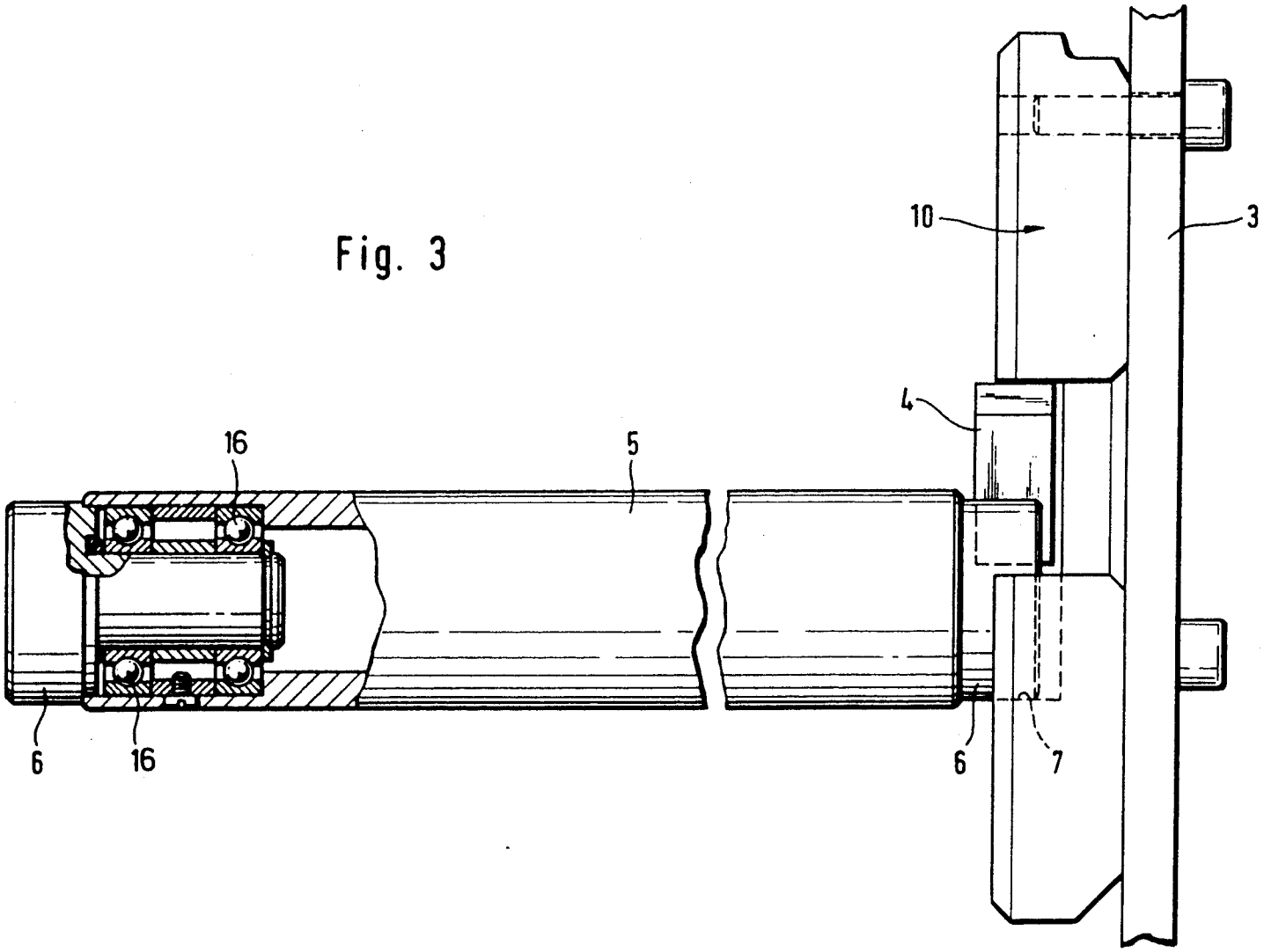

FIG. 3 shows bolts 6 rotatably mounted by ball bearings 16 at the ends of the winding rod 5. The winding rod 5 is held rotatably in the levers 3 with the aid of these bolts and is locked in position there, whereby the wedge-shaped locking means 4 engage on the free ends of the bolts 6.

Figure 2:
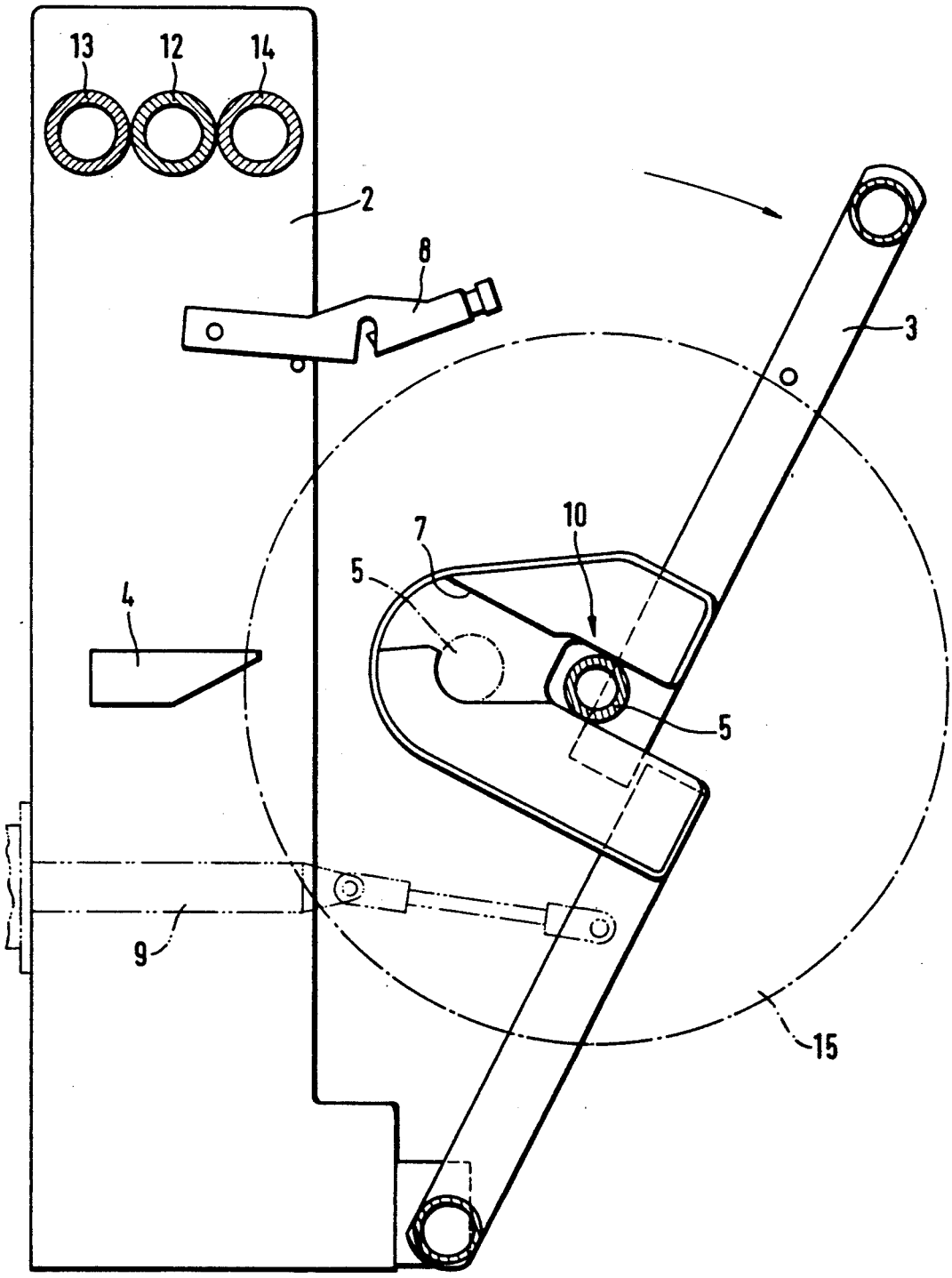
FIG. 2 is a schematic side view of a device for removal of a roll of tubular fabric in the removal position and FIG. 3 is a partially broken away front view of the winding rod mounted in a lever.

In order to remove the roll 15 of tubular fabric, the tubular fabric 11 is severed, for example at point S, once it has been wound around the roll 15 of tubular fabric and before it returns to the take-up roller 14. The levers 3 are then, as illustrated in FIG. 2, pivoted into the removal position. In this respect, a conventional retaining means 8 attached for the purpose of locking is released. The locking means 4 release the winding rod with the tubular fabric wound thereon. In the removal position, the grooves 7 are partially in a horizontal position so that the winding rod 5 can easily be rolled out of these grooves from its position in the operative position (illustrated by dash-dot lines in FIG. 2). The grooves 7, due to their angled shape, are partially located in the position of a downwardly inclined plane, on which the winding rod rolls automatically out of the grooves 7 due to the effect of gravity.

The pivoting movement of the levers 3 can also be optionally accomplished by (e.g. hydraulic) drive motors 9 or other devices. In this case, the retaining means 8 can be dispensed with since the drive motors 9 act as stop means in the operative position of the levers 3.

We claim:

1. A device for removing tubular fabric from a circular knitting machine while forming a roll of said fabric comprising a machine frame, at least one driven take-up roller around which said fabric is partially wrapped, means mounting said take-up roller on said frame, a rotatable winding rod on which said roll of tubular fabric is formed, said rod having ends, means mounting said rod on said frame in spaced relationship to said take-up roller, means for guiding said tubular fabric from the take-up roller to the roll of tubular fabric and from the roll of tubular fabric back to the take-up roller and from the take-up roller back again to the roll of tubular fabric, said rod-mounting means comprising levers formed with grooves for receiving the ends of said rod, means mounting said levers on said frame for pivotal movement between an operative position at which said roll of tubular fabric is formed on said rod and a doffing position at which said rod and a roll formed thereon are removed, said grooves being angled such that in the operative position of the levers the ends of the winding rod are held in the grooves by gravity and in the doffing position of the levers the ends of the winding rod exit freely from the grooves, respective bolts rotatably mounted at the ends of said rod in coaxial relationship thereto, locking means on said frame for locking said ends of said rod in said grooves and said levers in said operative position, said locking means comprising stationary wedge-shaped locking elements for engaging said bolts.

2. The device of claim 1, further comprising retaining means for retaining levers in said operative position.

3. The device of claim 1, further comprising a drive motor for pivoting said levers.

* * * * *